US007368677B2

(12) United States Patent
Jones et al.

(10) Patent No.: US 7,368,677 B2
(45) Date of Patent: May 6, 2008

(54) REVERSE BIAS HATCHET RESET SPRING

(75) Inventors: William John Jones, Cranberry Township, PA (US); Perry Robert Gibson, Beaver Falls, PA (US)

(73) Assignee: Eaton Corporation, Cleveland, OH (US)

( * ) Notice: Subject to any disclaimer, the term of this patent is extended or adjusted under 35 U.S.C. 154(b) by 343 days.

(21) Appl. No.: 11/302,758

(22) Filed: Dec. 14, 2005

(65) Prior Publication Data

US 2007/0131526 A1 Jun. 14, 2007

(51) Int. Cl.
*H01H 3/00* (2006.01)

(52) U.S. Cl. ..... 200/400

(58) Field of Classification Search ..... 200/400, 200/401, 500, 501; 218/154; 335/171–179
See application file for complete search history.

(56) References Cited

U.S. PATENT DOCUMENTS

| | | | | |
|---|---|---|---|---|
| 3,648,429 | A | 3/1972 | Davidson et al. | |
| 4,137,437 | A | 1/1979 | Maier et al. | |
| 4,162,385 | A | 7/1979 | Bould et al. | |
| 4,163,133 | A | 7/1979 | Bould | |
| 4,580,021 | A | 4/1986 | Fujikake | |
| 4,636,762 | A | 1/1987 | Marquardt et al. | |
| 4,709,127 | A | 11/1987 | Adam | |
| 4,719,325 | A | 1/1988 | Kroll et al. | |
| 4,764,650 | A | 8/1988 | Bur et al. | |
| 4,871,889 | A | 10/1989 | Leone et al. | |
| 4,885,444 | A | 12/1989 | Lazar et al. | |
| 4,901,821 | A | 2/1990 | Robbins | |
| 4,916,268 | A * | 4/1990 | Micoud et al. | 200/400 |
| 5,224,590 | A | 7/1993 | Milianowicz et al. | |
| 5,260,533 | A | 11/1993 | Livesey et al. | |
| 5,486,667 | A | 1/1996 | Castonguay et al. | |
| 5,571,255 | A | 11/1996 | Baginski et al. | |
| 6,064,021 | A * | 5/2000 | Wehrli et al. | 200/400 |
| 6,072,136 | A * | 6/2000 | Wehrli et al. | 200/401 |
| 6,376,788 | B1 | 4/2002 | Jones et al. | |
| 6,437,269 | B1 * | 8/2002 | Rakus | 200/400 |
| 6,472,627 | B1 * | 10/2002 | Yoon | 200/400 |
| 6,610,949 | B2 * | 8/2003 | Mori et al. | 200/400 |
| 6,667,452 | B2 * | 12/2003 | Spiegel | 200/501 |
| 6,788,172 | B1 * | 9/2004 | Godesa et al. | 335/17 |
| 6,831,244 | B2 * | 12/2004 | Kawamoto et al. | 218/78 |
| 7,115,830 | B1 * | 10/2006 | Weister et al. | 200/400 |

* cited by examiner

*Primary Examiner*—Michael A. Friedhofer
(74) *Attorney, Agent, or Firm*—Martin J. Moran

(57) ABSTRACT

A spring offset device is structured to extend between a circuit breaker frame assembly and a trip mechanism. The offset device includes an offset member disposed on a trip device banana link, a spring anchor disposed on the frame assembly, and a spring extending between the offset member and the spring anchor. The spring anchor is spaced from the hatchet pin assembly and, preferably positioned so that the longitudinal axis of the spring remains on a single side of a hatchet pin assembly axis as the banana link moves between a closed position, an open position, and a reset position. The offset member and the spring anchor are structured so that, when the hatchet plate is in the closed position, the spring creates an opening force on the hatchet plate biasing the hatchet plate toward the open position, and when the hatchet plate is in the reset position, the spring creates a closing force on the hatchet plate biasing the hatchet plate toward the closed position.

19 Claims, 12 Drawing Sheets

REVERSE BIAS HATCHET RESET SPRING

BACKGROUND OF THE INVENTION

1. Field of the Invention

The present invention relates to a circuit breaker and, more specifically, to a circuit breaker having a trip mechanism with a hatchet plate that is acted upon by a spring so that when the circuit breaker is open the spring biases the hatchet plate toward the rest position and when the circuit breaker is closed the spring biases the hatchet plate toward the trip or open position.

2. Background Information

Electrical switching apparatus for opening and closing electric power circuits typically utilize an energy storage device in the form of one or more large springs to close the contacts of the device into the large currents which can be drawn in such circuits. Such electrical switching apparatus includes power circuit breakers and network protectors which provide protection, and electric switches which are used to energize and deenergize parts of the circuit or to transfer between alternative power sources. These devices also include an open spring which rapidly separates the contacts to interrupt current flowing in the power circuit. Either or both of the close spring and open spring can be a single spring or multiple springs and should be considered as either, even though the singular is hereafter used for convenience. The open spring is charged during closing of the contacts by the close spring which, therefore, must store sufficient energy to both overcome the mechanical and magnetic forces for closing as well as charging the open springs. Moreover, the close spring is required to have sufficient energy to close and latch on at least 15 times the rated current.

The operating mechanism for such circuit breakers typically includes a manual handle, and often an electric motor, for charging the close spring. It also includes a latch mechanism for latching the close spring in the charged state, a release mechanism for releasing the stored energy in the close spring, and an arrangement, a pole shaft for example, for coupling the released energy into the moving conductor assembly supporting the moving contacts of the switch. The operating mechanism has four distinct operational phases, or "conditions," relating to the position of the main contacts, open or closed, and the state of the close spring, discharged or charged. First, there is an open, discharged condition wherein the circuit breaker main contacts are open and the close spring is discharged. To close the main contacts, the close spring is charged resulting in an open, charged condition. After the close spring is actuated, the main contacts are closed and the close spring is discharged resulting in a closed, discharged condition. Finally, the charge spring may be recharged while the main contacts are closed resulting in a closed, charged condition. The operating mechanism does not always pass through each of these conditions in the order set forth above. For example, after the contacts are closed, it is standard practice to charge the close spring again so that the close spring is ready to be used again. If the circuit breaker trips while in the closed, charged condition, the operating mechanism will be moved into the open, charged condition without being in the open, discharged condition.

The operating mechanism includes a latch mechanism. The latch mechanism includes a hatchet plate that is fixed to a hatchet plate pivot pin and structured to move between an open position, a reset position, and a closed position. The status of the hatchet plate is tied to the condition of the operating mechanism, and more specifically to the condition of the main contacts. That is, if the hatchet plate is in the open position, the main contacts will also be in the open condition. When the hatchet plate is in the reset position, the operating mechanism is in the open, charged condition. When the hatchet plate is in the closed position, the main contacts are in the closed condition, although the close spring may be charged or discharged.

The hatchet plate is coupled to the other components of the operating mechanism via a link which, due to its particular shape in the circuit breaker described below, is identified as a "banana link." The hatchet plate is also coupled to a frame assembly via a spring. In prior art, the rest spring was typically attached to the hatchet plate at the banana link pivot pin and biased the hatchet in the reset direction. The disadvantage to this configuration is that the reset bias of the spring tends to prevent tripping of the circuit breaker under unfavorable conditions of high friction and/or low contact force.

There is, therefore, a need for a spring offset device having an offset member, a spring anchor, and a spring extending therebetween structured so that when the circuit breaker is closed, the spring creates a force on the hatchet plate biasing the hatchet plate toward the open, trip position, but when the circuit breaker is open, the spring creates a force on the hatchet plate biasing the hatchet plate toward the reset position.

There is a further need for a spring offset device that may be easily incorporated into presently existing circuit breakers.

SUMMARY OF THE INVENTION

These needs, and others, are met by the present invention which provides a spring offset device structured to extend between a circuit breaker frame assembly and a trip mechanism. The offset device includes an offset member disposed on the banana link, a spring anchor disposed on the frame assembly, and a spring extending between the offset member and the spring anchor. The offset member and the spring anchor are structured so that the force on the offset member is transferred to the banana link through a pin or tab so that the torque on the offset member is transferred directly to the banana link. The spring, acting on the banana link, imparts both a compressive force to the banana link and a torque about its lower pivot pin. The spring creates both a compressive force along the axis of the banana link (a counterclockwise or reset torque) and a force perpendicular to the axis (a clockwise or tripping torque). The tripping torque is relatively constant as the breaker moves from open to closed. But the reset torque reduces dramatically as the axis of the banana link moves closer to the pivot shaft of the hatchet plate. When the breaker is open, the reset torque exceeds the tripping torque and the net torque on the hatchet plate moves it to the reset position. But as the breaker closes and the line of action shifts, the net torque produced by the spring reverses and becomes a tripping torque, which aids the reliable opening of the breaker.

BRIEF DESCRIPTION OF THE DRAWINGS

A full understanding of the invention can be gained from the following description of the preferred embodiments when read in conjunction with the accompanying drawings in which.

Need.

DESCRIPTION OF THE PREFERRED EMBODIMENTS

As used herein, the phrase "disposed on" means "incorporated into" or "coupled with."

As used herein, the phrase "incorporated into" means that two components are unitary or integral to each other such as, but not limited to, a single, cast element or two elements that are fixed together, such as by welding.

As used herein, the phrase "coupled with" means that two components are created as separate elements and are associated with each other either directly or indirectly. For example, a first component that sits on a second component is coupled thereto. Further, a first component and a second component with, for example, a spring extending therebetween are also coupled together.

The invention will be described as applied to a power air circuit breaker; however, it also has application to other electrical switching apparatus for opening and closing electric power circuits. For instance, it has application to switches providing a disconnect for branch power circuits and transfer switches used to select alternate power sources for a distribution system. The major difference between a power circuit breaker and these various switches is that the circuit breaker has a trip mechanism which provides overcurrent protection. The invention could also be applied to network protectors which provide protection and isolation for distribution circuits in a specified area.

This invention may be used with the apparatus disclosed in U.S. Pat. No. 6,072,136, which is incorporated by reference. U.S. Pat. No. 6,072,136 provides a full description of the charging mechanism, as well as various other components of the circuit breaker, which are not relevant to the present invention.

Figure 1:
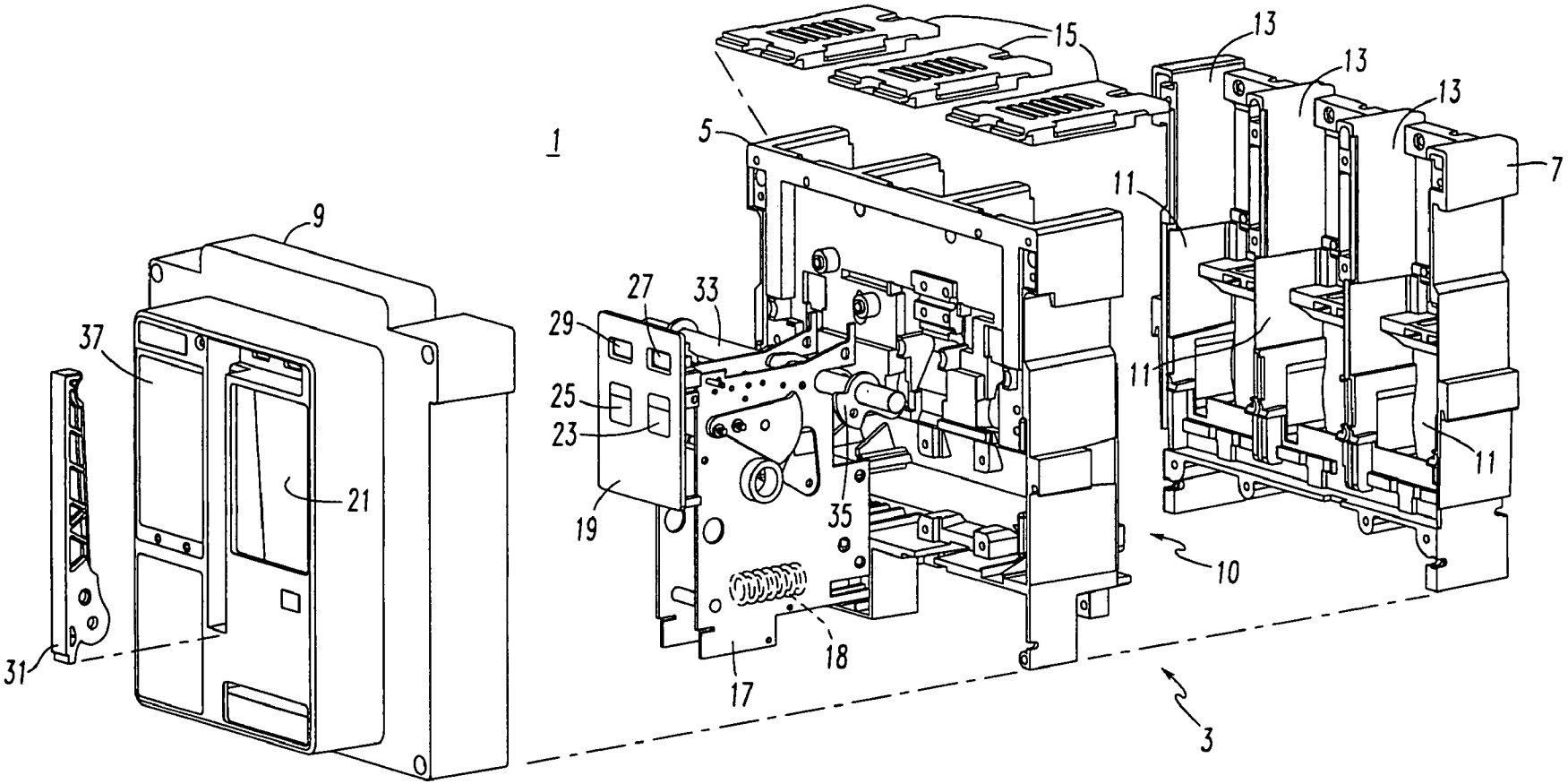
FIG. 1 is an exploded isometric view of a low voltage, high current power circuit breaker in accordance with the invention.

Referring to FIG. 1, the power air circuit breaker 1 of the invention has a housing 3 which includes a molded front casing 5 and a rear casing 7, and a cover 9. The exemplary circuit breaker 1 has three poles 10 with the front and rear casings 5, 7 forming three, pole chambers 11. Each pole 10 has an arc chamber 13 which is enclosed by a ventilated arc chamber cover 15.

Circuit breaker 1 has an operating mechanism 17 which is mounted on the front of the front casing 5 and is enclosed by the cover 9. The operating mechanism 17 has a face plate 19 which is accessible through an opening 21 in the cover. The operating mechanism 17 includes a large close spring 18 which is charged to store energy for closing the circuit breaker 1. Face plate 19 mounts a push to close button 23 which is actuated to discharge the close spring 18 for closing the circuit breaker 1, and a push to open button 25 for opening the circuit breaker 1. Indicators 27 and 29 display the condition of the close spring 18 and the open/closed state of the contacts, respectively. The close spring 18 is charged by operation of the charging handle 31 or remotely by a motor operator (not shown).

The common operating mechanism 17 is connected to the individual poles 10 by a pole shaft 33 with a lobe 35 for each pole 10. As is conventional, the circuit breaker 1 includes an electronic trip unit 37 supported in the cover 9 which actuates the operating mechanism 17 to open all of the poles 10 of the circuit breaker 1 through rotation of the pole shaft 33 in response to predetermined characteristics of the current flowing through the circuit breaker 1.

Figure 2:
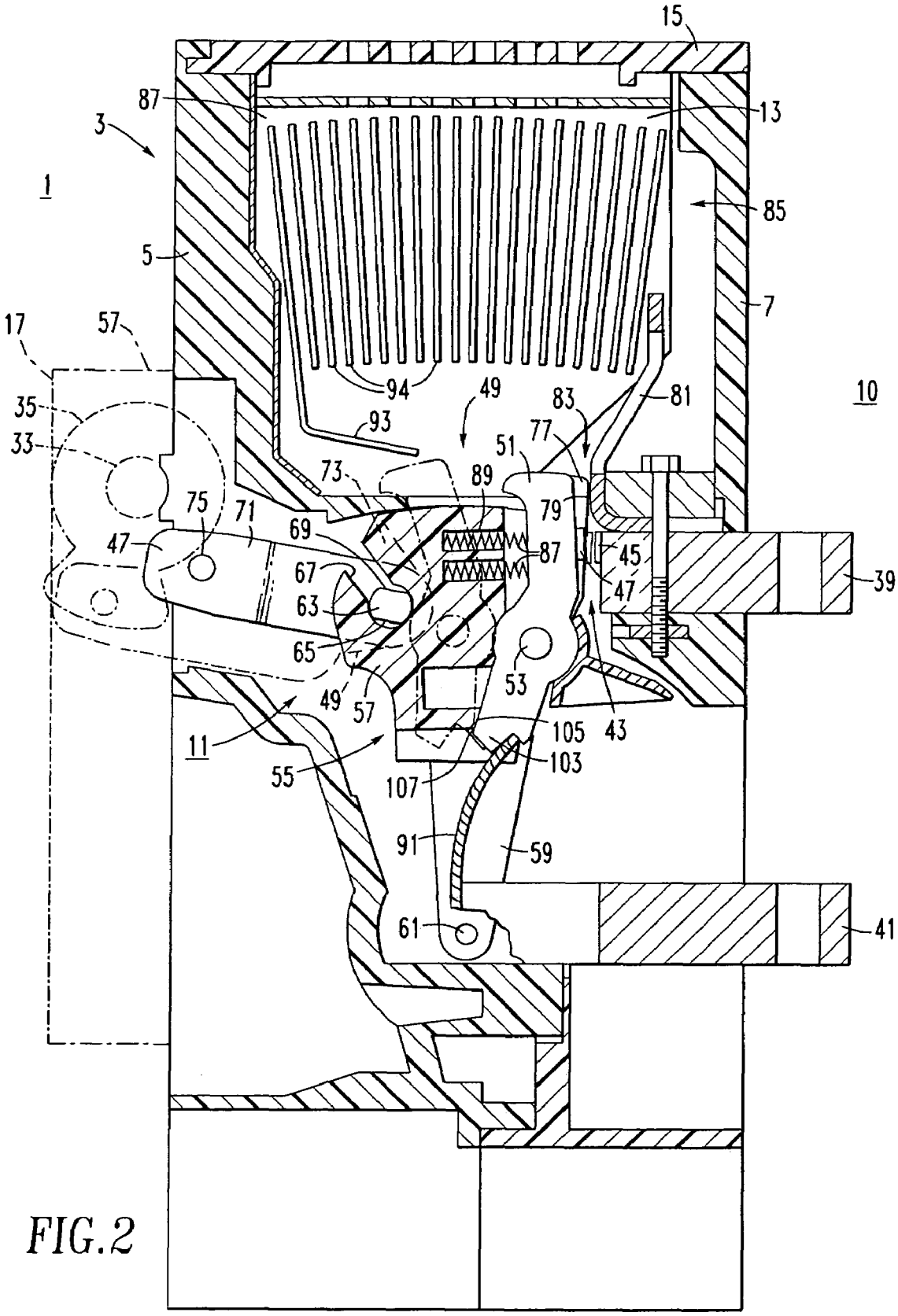
FIG. 2 is a vertical section through a pole of the circuit breaker of FIG. 1 shown as the contacts separate during opening.

FIG. 2 is a vertical section through one of the pole chambers 11. The pole 10 includes a line side conductor 39 which projects out of the rear casing 7 for connection to a source of ac electric power (not shown). A load conductor 41 also projects out of the rear casing 7 for connection typically to the conductors of the load network (also not shown).

Each pole 10 also includes a pair of main contacts 43 that include a stationary main contact 45 and a moveable main contact 47. The moveable main contact 47 is carried by a moving conductor assembly 49. This moving conductor assembly 49 includes a plurality of contact fingers 51 which are mounted in spaced axial relation on a pivot pin 53 secured in a contact carrier 55. The contact carrier 55 has a molded body 57 and a pair of legs 59 (only one shown) having pivots 61 rotatably supported in the housing 3.

The contact carrier 55 is rotated about the pivots 61 by the operating mechanism 17 which includes a drive pin 63 received in a transverse passage 65 in the carrier body 57 through a slot 67 to which the drive pin 63 is keyed by flats 69. The drive pin 63 is fixed on a drive link 71 which is received in a groove 73 in the carrier body. The other end of the drive link 71 is pivotally connected by a pin 75 to the associated lobe arm 35 on the pole shaft 33 similarly connected to the carriers (not shown) in the other poles of the circuit breaker 1. The pole shaft 33 is rotated by the operating mechanism 17.

A moving main contact 47 is fixed to each of the contact fingers 51 at a point spaced from the free end of the finger 51. The portion of the contact finger 51 adjacent the free end forms a moving arcing contact or "arc toe" 77. A stationary arcing contact 79 is provided on the confronting face of an integral arcing contact and runner 81 mounted on the line side conductor 39. The stationary arcing contact 79 and arc toe 77 together form a pair of arcing contacts 83. The integral arcing contact 83 and runner 81 extends upward toward a conventional arc chute 85 mounted in the arc chamber 13.

The contact fingers 51 are biased clockwise as seen in FIG. 2 on the pivot pin 53 of the carrier 55 by pairs of helical compression springs 87, the "open springs," seated in recesses 89 in the carrier body 57. The operating mechanism 17 rotates the pole shaft 33 which, in turn, pivots the contact carrier 55 clockwise to a closed position (not shown) to close the main contacts 43. To open the contacts 43, the operating mechanism 17 releases the pole shaft 33 and the compression springs 87 accelerate the carrier 55 in a counterclockwise direction to an open position (not shown). As the carrier 55 is rotated clockwise toward the closed position, the arc toes 77 contact the stationary arcing contacts 79 first. As the carrier 55 continues to move clockwise, the compression springs 87 compress as the contact fingers 51 rock about the pivot pin 53 until the main contacts 43 close. Further clockwise rotation to the fully closed position (not shown) results in opening of the arcing contacts 83 while the main contacts 43 remain closed. In that closed position, a circuit is completed from the line side conductor 39 through the closed main contacts 43, the contact fingers 51, flexible shunts 91, and the load conductor 41.

To open the circuit breaker 1, the operating mechanism 17 releases the pole shaft 33 so that the compressed springs 87 accelerate the carrier 55 counterclockwise as viewed in FIG. 2. Initially, as the carrier 55 moves away from the line side conductor 39, the contact fingers 51 rock so that the arcing contacts 83 close while the main contacts 43 remain closed. As the carrier 55 continues to move counterclockwise, the main contacts 43 open and all of the current is transferred to the arcing contacts 83 which is the condition shown in FIG. 2. If there is a sizeable current being carried by the circuit breaker 1 such as when the circuit breaker 1 trips open in response to an overcurrent or short circuit, an arc is struck between the stationary arcing contacts 79 and the moveable arcing contacts or arc toes 77 as these contacts separate with continued counterclockwise rotation of the carrier 55. As the main contacts 43 have already separated, the arcing is confined to the arcing contacts 83 which preserves the life of the main contacts 43. The electromagnetic forces produced by the current sustained in the arc push the arc outward toward the arc chute 85 so that the end of the arc at the stationary contact 79 moves up the integral arcing contact 83 and runner 81 and into the arc chute 85. At the same time, the rapid opening of the carrier 55 brings the arc toes 77 adjacent the free end of the arc top plate 93 as shown in phantom in FIG. 2 so that the arc extends from the arc toes 77 to the arc top plate 93 and moves up the arc top plate 93 into the arc plates 94 which break the arc up into shorter sections which are then extinguished.

Figure 3:
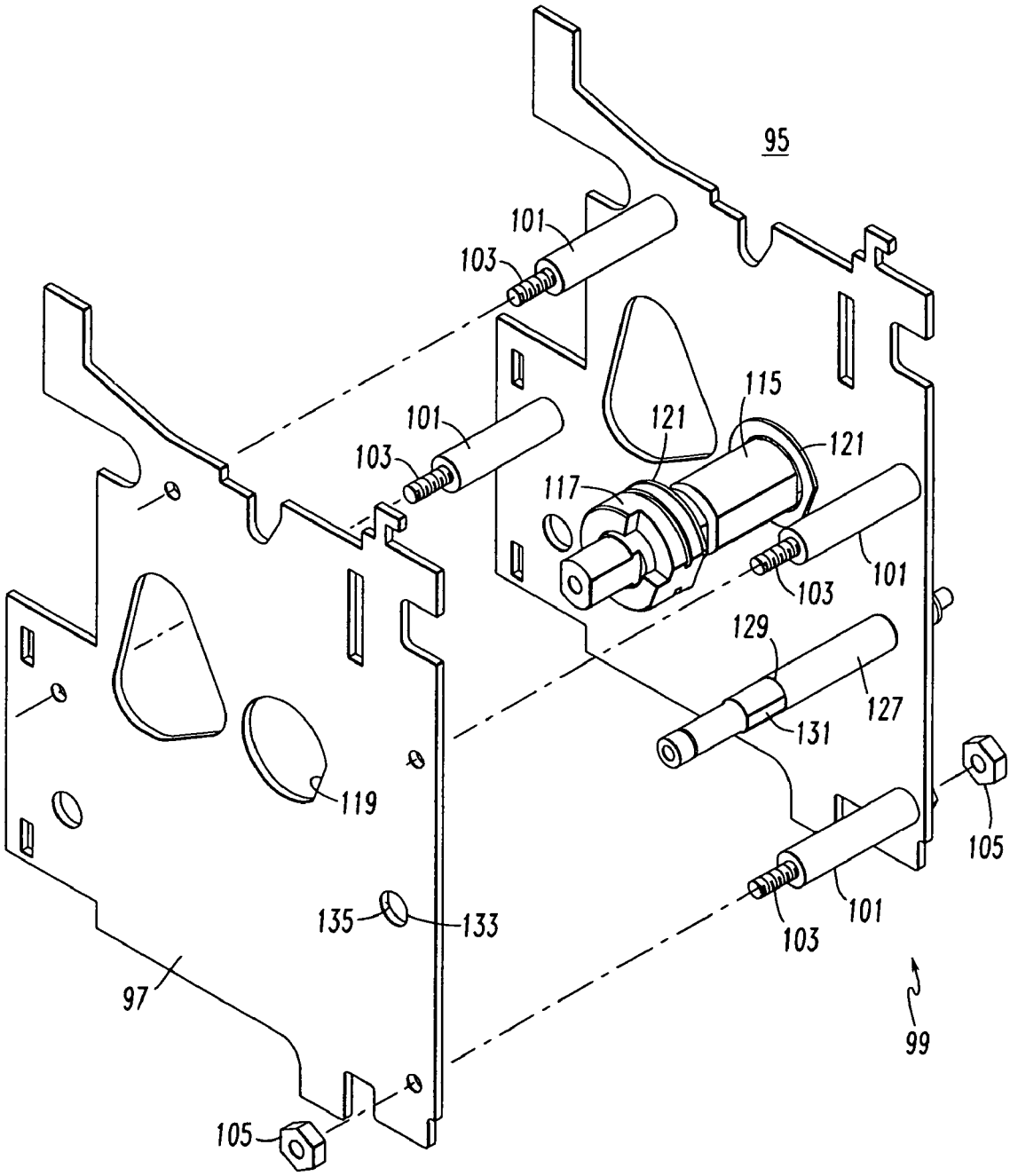
FIG. 3 is an exploded isometric view of a cage assembly which forms part of the operating mechanism of the circuit.
Figure 4:
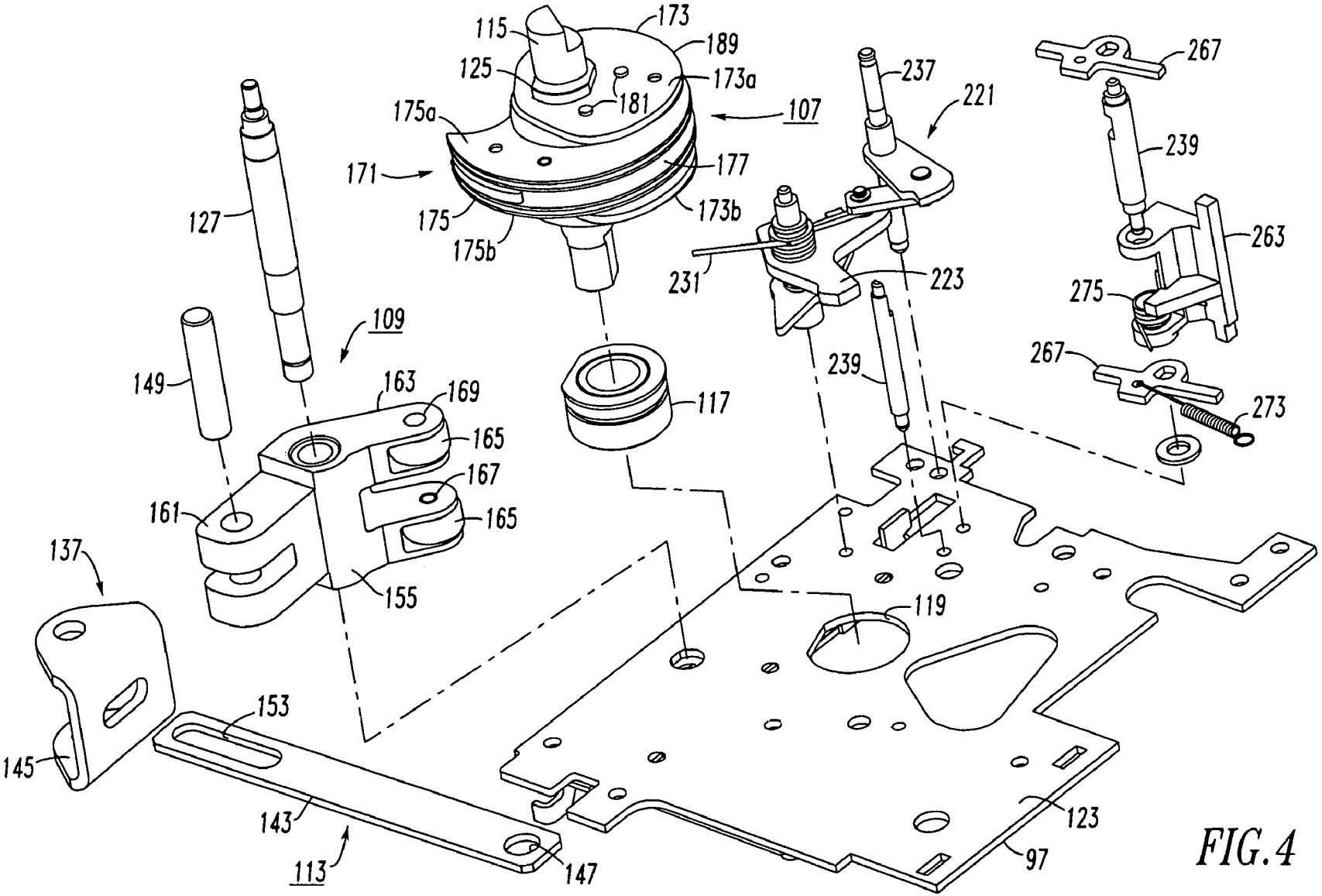
FIG. 4 is an exploded isometric view illustrating assembly of the operating mechanism.
Figure 5:
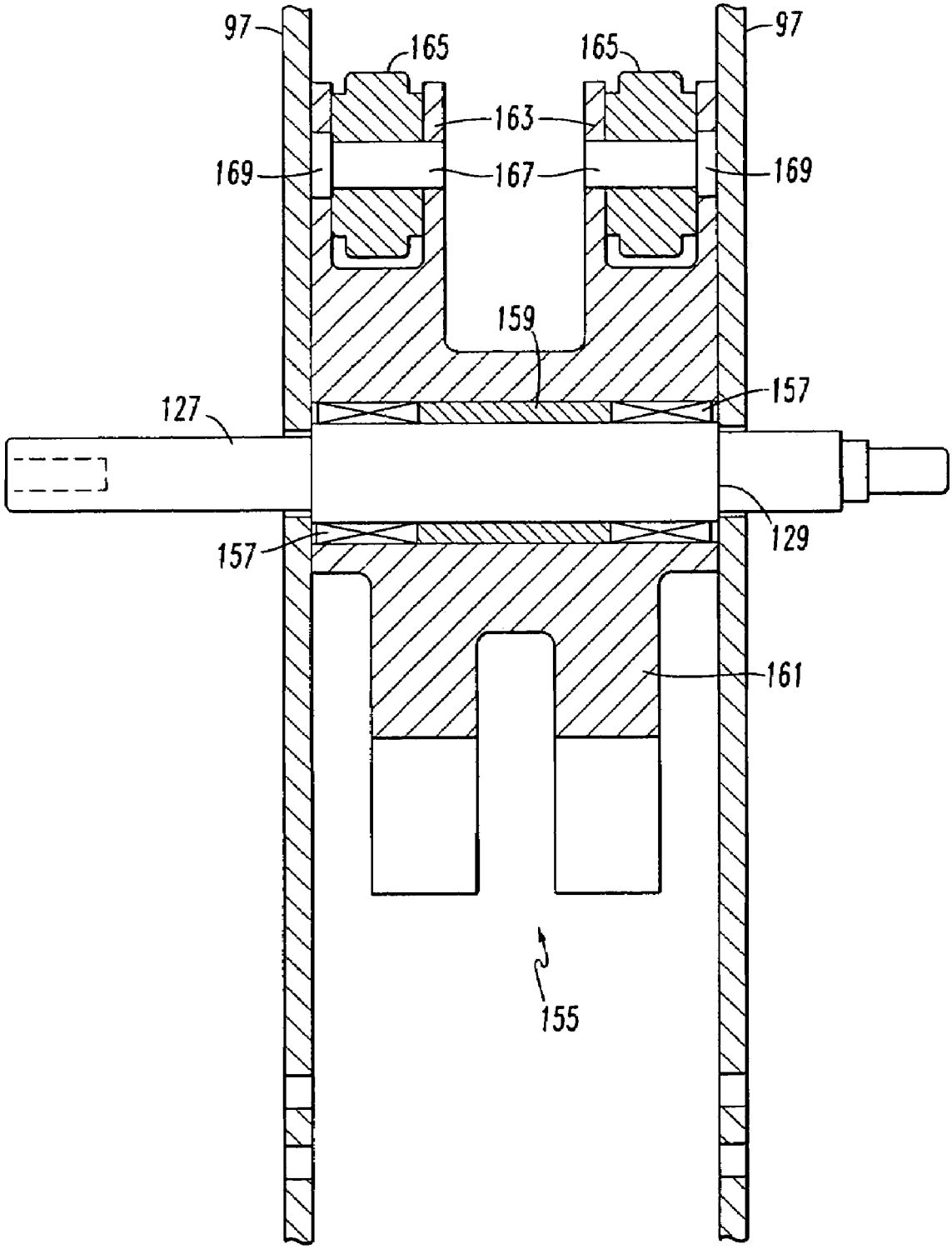
FIG. 5 is a partial vertical sectional view through an assembled operating mechanism taken through the rocker assembly.

The operating mechanism 17 is a self supporting module having a frame assembly 95. As shown in FIG. 3, the frame assembly 95 includes two side plates 97 which are identical and interchangeable. The side plates 97 are held in spaced relation by four elongated members 99 formed by spacer sleeves 101, and threaded shafts 103 and nuts 105 which clamp the side plates 97 against the spacer sleeves 101. Four major subassemblies and a large close spring 18 make up the power portion of the operating mechanism 17. The four major subassemblies are the cam assembly 107, the rocker assembly 109, the main link assembly 111 and a close spring support assembly 113. All of these components fit between the two side plates 97. Referring to FIGS. 3 and 4, the cam assembly 107 includes a cam shaft 115 which is journaled in a non-cylindrical bushing 117 which are seated in complementary non-cylindrical openings 119 in the side plates 97. The bushing 117 has a flange 121 which bears against the inner face 123 of the side plate 97, and the cam shaft 115 has shoulders 125 which position it between the bushing 117 and the collar 222 so that the cam shaft 115 and the bushing 117 are captured between the side plates 97 without the need for fasteners. Similarly, a rocker pin 127 of the rocker assembly 109 has shoulders 129 which capture it between the side plates 97 as seen in FIGS. 3-5. Flats 131 on the rocker pin 127 engage similar flats 133 in openings 135 in the side plates 97 to prevent rotation of the rocker pin 127. The cam shaft 115 and rocker pin 127 add stability to the frame assembly 95 which is self-aligning and needs no special fixturing for alignment of the parts during assembly. As the major components are "sandwiched" between the two side plates 97, the majority of the components need no additional hardware for support. As will be seen, this sandwich construction simplifies assembly of the operating mechanism 17.

Figure 6:
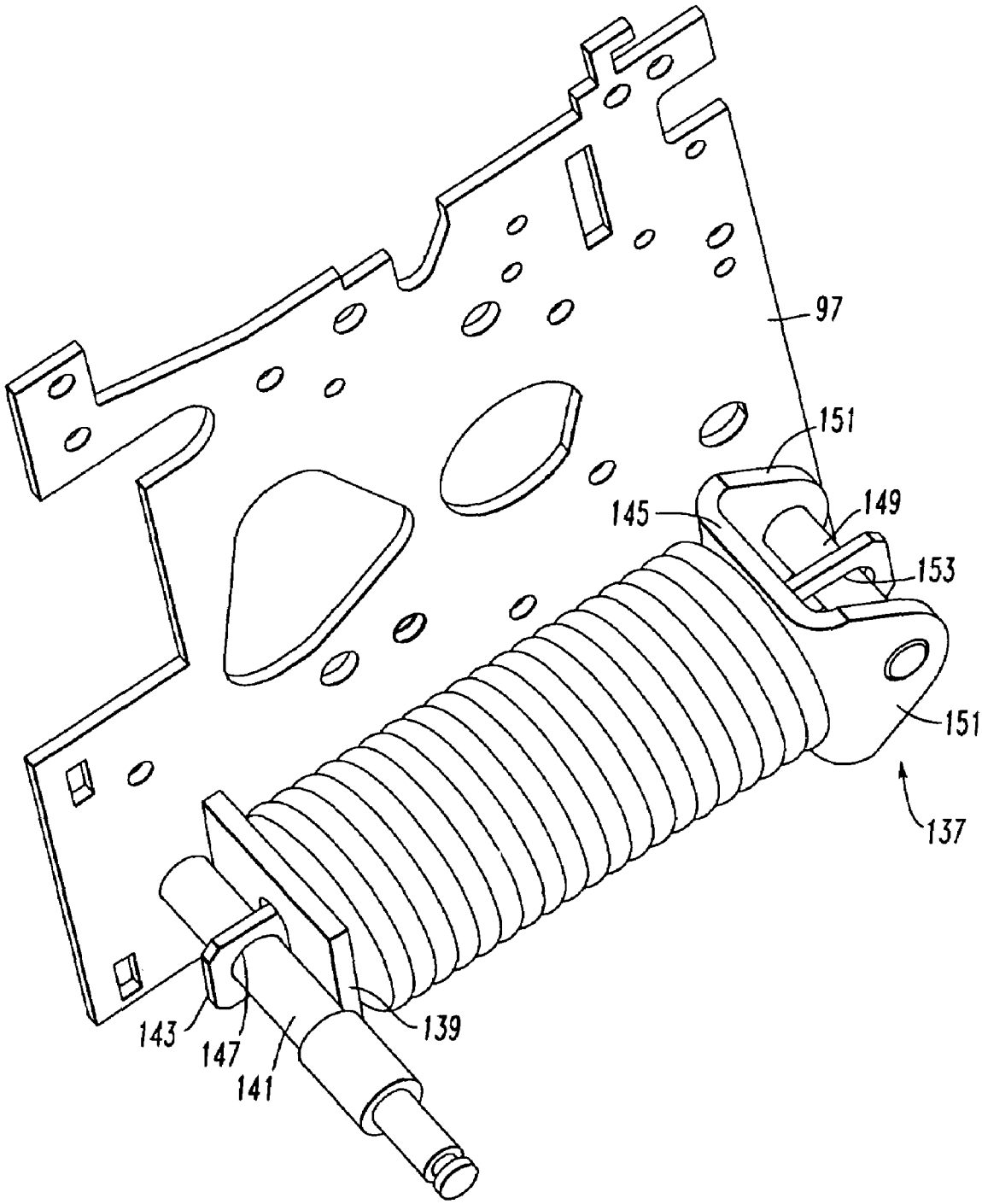
FIG. 6 is an isometric view illustrating the mounting of the close spring which forms part of the operating mechanism.
Figure 7:
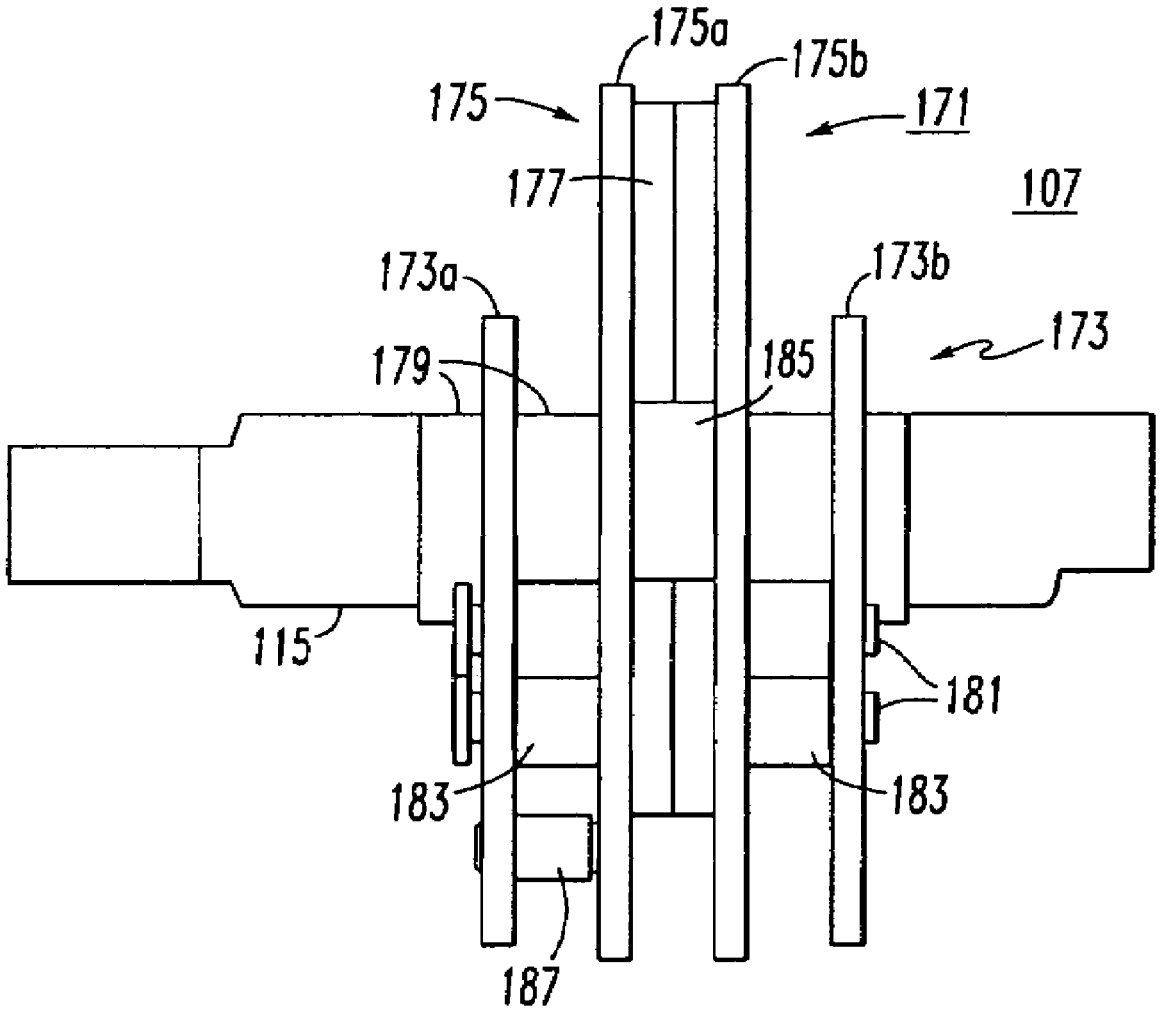
FIG. 7 is a side elevational view of the cam assembly which forms part of the operating mechanism.

The close spring 18 is a common, round wire, heavy duty, helical compression spring 87 closed and ground flat on both ends. A compression spring 87 is used because of its higher energy density than a tension spring. The helical compression close spring 18 is supported in a very unique way by the close spring support assembly 113 in order to prevent stress risers and/or buckling. In such a high energy application, it is important that the ends of the close spring 18 be maintained parallel and uniformly supported and that the spring 18 be laterally held in place. As illustrated particularly in FIGS. 4 and 6, and also in FIGS. 8-11, this is accomplished by compressing the helical compression close spring 18 between a U-bracket 137 which is free to rotate and also drive the rocker assembly 109 at one end, and a nearly square spring washer or guide plate 139 which can pivot against a spring stop or support pin 141 which extends between the slide plates 97 at the other end. The close spring 18 is kept from "walking" as it is captured between the two side plates 97, and is laterally restrained by an elongated guide member 143 that extends through the middle of the spring 18, the guide plate 139 and the brace 145 of the U-bracket 137. The elongated guide member 143, in turn, is captured on one end by the support pin 141 which extends through an aperture 147, and on the other end by a bracket pin 149 which extends through legs 151 on the U-bracket 137 and an elongated slot 153 in the elongated member 143.

The rocker assembly 109 includes a rocker 155 pivotally mounted on the rocker pin 127 by a pair of roller bearings 157 which are captured between the side plates 97 and held in spaced relation by a sleeve 159 as best seen in FIG. 5. The rocker 155 has a clevis 161 on one end which pivotally connects the rocker 155 to the U-bracket 137 through the bracket pin 149. A pair of legs 163 on the other end of the rocker 155 which extend at an obtuse angle to the clevis 161, form a pair of roller devises which support rocker rollers 165. The rocker rollers 165 are pivotally mounted to the roller clevises 161 by pins 167. These pins 167 have heads 169 facing outwardly toward the side plates 97 so that they are captured and retained in place without the need for any snap rings or other separate retainers. As the rocker 155 rocks about the rocker pin 127, the guide plate 139 rotates on the spring support pin 141 so that the loading on the close spring 18 remains uniform regardless of the position of the rocker 155. The close spring 18, guide plate 139 and spring support pin 141 are the last items that go into an operating mechanism 17 so that the close spring 18 can be properly sized for the application.

The U-bracket pin 149 transfers all of the spring loads and energy to the rocker clevis 161 on the rocker 155. The translational loads on the rocker 155 are transferred into the non-rotating rocker pin 127 and from there into the two side plates 97 while the rocker 155 remains free to rotate between the side plates 97.

Referring to FIGS. 4-11, the cam assembly 107 includes, in addition to the cam shaft 115, a cam member 171. The cam member 171 includes a charge cam 173 formed by a pair of charge cam plates 173*a*, 173*b* mounted on the cam shaft 115. The charge cam plates 173*a*, 173*b* straddle a drive cam 175 which is formed by a second pair of cam plates 175*a*, 175*b*. A cam spacer 177 sets the spacing between the drive cam plates 175*a*, 175*b* while spacer bushings 179 separate the charge cam plates 173*a*, 173*b* from the drive cam plates 175*a*, 175*b* and from the side plates 97. The cam plates 173*a*, 173*b*, 175*a*, 175*b* are all secured together by rivets 181 extending through rivet spacers 183 between the plates 97. A stop roller 185 is pivotally mounted between the drive cam plates 175*a* and 175*b* and a reset pin 187 extends between the drive cam plate 175*a* and the charge cam plate 173*a*. The cam assembly 107 is a 360° mechanism which compresses the close spring 18 to store energy during part of the rotation, and which is rotated by release of the energy stored in the close spring 18 during the remainder of rotation. This is accomplished through engagement of the charge cam plates 173*a*, 173*b* by the rocker rollers 165. The preload on the close spring 18 maintains the rocker rollers 165 in engagement with the charge cam plates 173*a*, 173*b*. The charge cam 173 has a cam profile 189 with a charging portion 189*a* which at the point of engagement with the rocker rollers 165 increases in diameter with clockwise rotation of the cam member 171. The cam shaft 115 and therefore the cam member 171 is rotated either manually by the charging handle 31 or by an electric motor (not shown). The charging portion 189*a* of the charge cam profile 189 is configured so that a substantially constant torque is required to compress the close spring 18. This provides a better feel for manual charging and reduces the size of the motor required for automatic charging as the constant torque is below the peak torque which would normally be required as the spring 18 approaches the filly compressed condition.

The cam profile 189 on the charge cam 173 also includes a closing portion 189*b* which decreases in diameter as the charge cam 173 rotates against the rocker rollers 165 so that the energy stored in the close spring 18 drives the cam member 171 clockwise when the mechanism is released.

The drive cam 175 of the cam member 171 has a cam profile 191 which, in certain rotational positions, is engaged by a drive roller 193 mounted on a main link 195 of the main link assembly 111 by a roller pin 197. The other end of the main link 195 is pivotally connected to a drive arm 199 on the pole shaft 33 by a pin 201. This main link assembly 111 is coupled to the drive cam 175 for closing the circuit breaker 1 by a trip mechanism 203 which includes a hatchet plate 205 pivotally mounted on a hatchet pivot pin assembly 207 supported by the side plates 97, and biased counterclockwise by a spring 300, as detailed below. A banana link 209 is an elongated member which, in this embodiment has a slightly curved shape. The banana link 209 has a first end 208 and a second end 210. The banana link first end 208 is pivotally connected to an extension on the roller pin 197 of the main link assembly 111. The banana link second end 210 is pivotally connected to one end of the hatchet plate 205. The other end of the hatchet plate 205, that is, on the opposite side of the hatchet plate 205 pivot point, as described below, has a latch ledge 211 which engages a trip D shaft 213 when the shaft is rotated to a latch position. With the hatchet plate 205 latched, the banana link 209 holds the drive roller 193 in engagement with the drive cam 175. In operation, when the trip D shaft 213 is rotated to a trip position, the latch ledge 211 slides off of the trip D shaft 213 and the hatchet plate 205 passes through a notch 215 in the trip D shaft 213 which repositions the pivot point of the banana link 209 connected to the hatchet plate 205 and allows the drive roller 193 to float independently of the drive cam 175.

Figure 8:
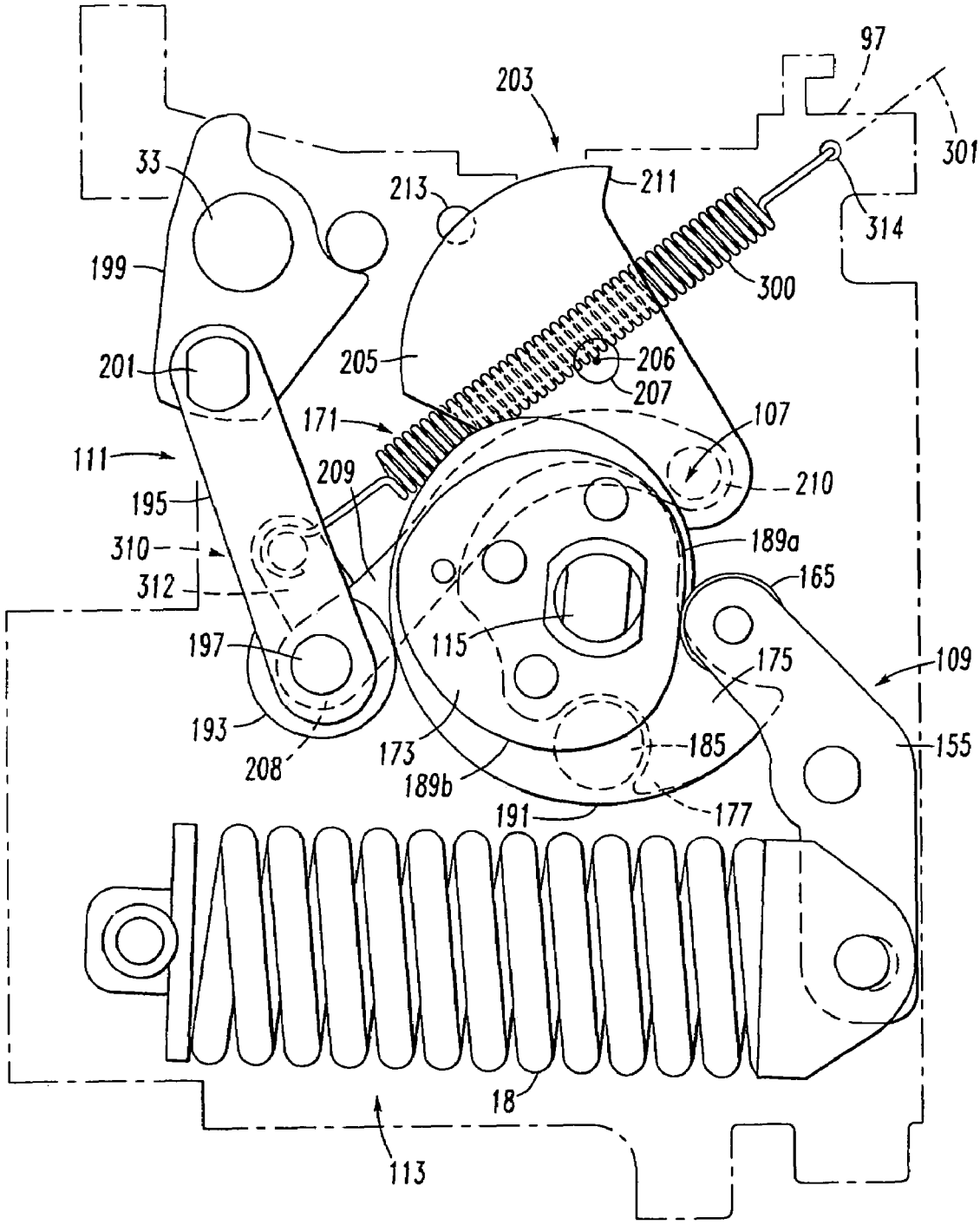
FIG. 8 is an elevation view illustrating the relationship of the major components of the operating mechanism shown with the contacts open and the close spring discharged.
Figure 9:
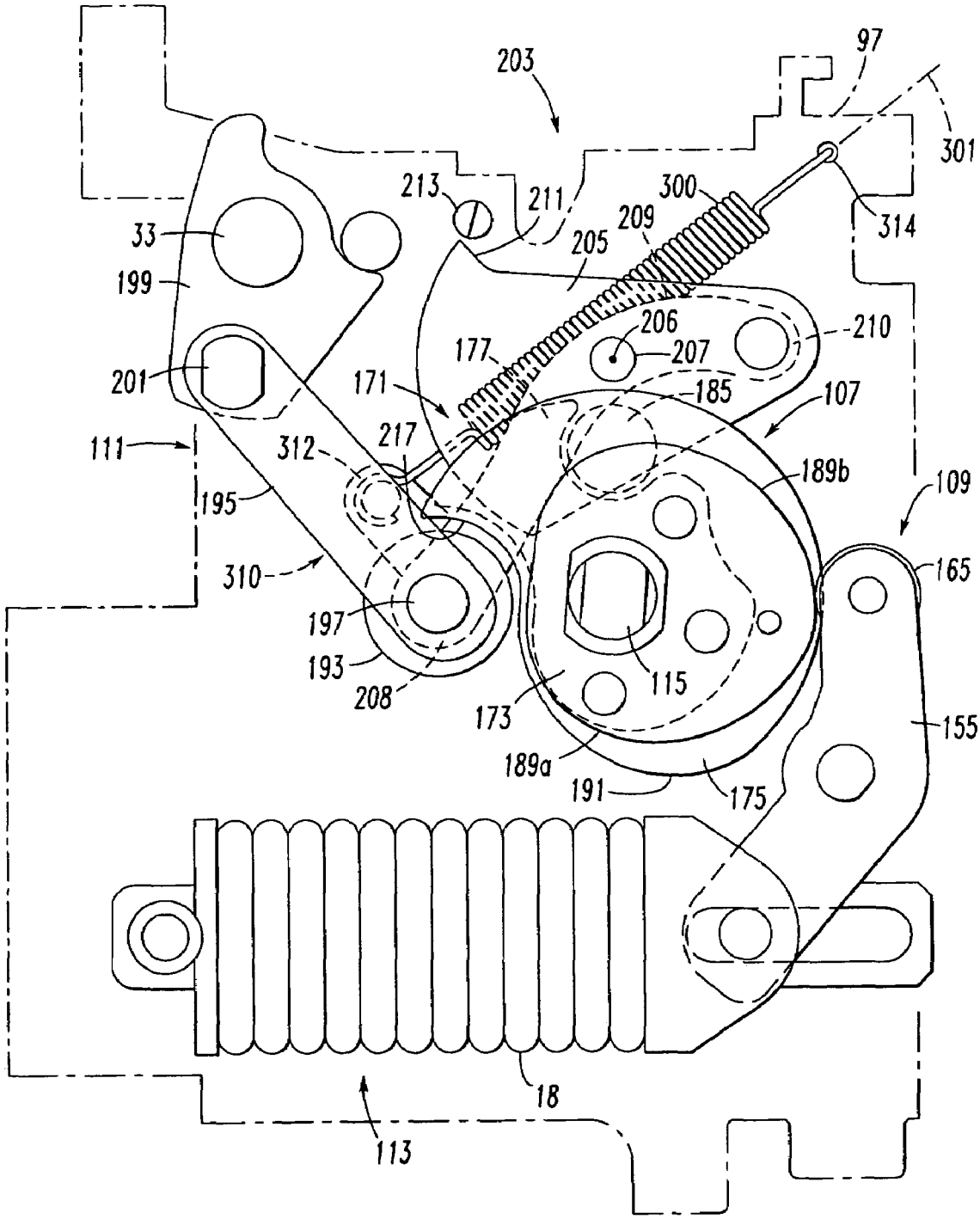
FIG. 9 is a view similar to FIG. 8 shown with the contacts open and the close spring charged.
Figure 10:
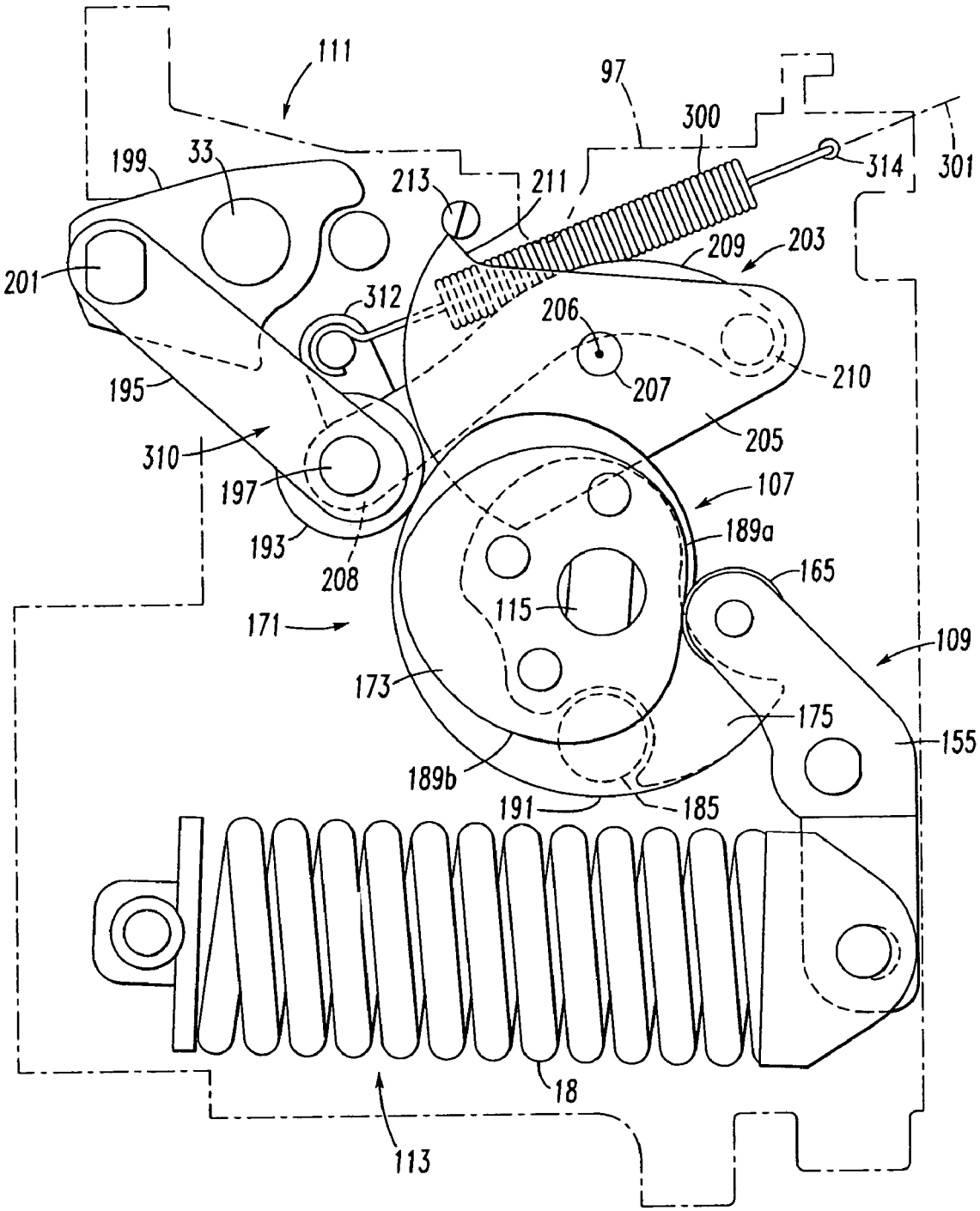
FIG. 10 is a view similar to FIG. 8 shown with the contacts closed and the close spring discharged.

The sequence of charging and discharging the close spring 18 can be understood by reference to FIGS. 8-11. It should be understood that there are two conditions for two components; the close spring 18 which may be charged or discharged, and the main contacts 43 which may be open or closed. Thus, FIGS. 8-11 show the four combinations of these conditions. That is, in FIG. 8, the main contacts 43 (not shown) are in the open position and the close spring 18 is discharged. In FIG. 9, the close spring 18 is charged and the main contacts 43 (not shown) remain open. In FIG. 10, the close spring 18 has been discharged to close the main contacts 43 (not shown). Finally, in FIG. 11, the main contacts 43 (not shown) remain closed and the close spring 18 has been charged. A detailed description of the sequence to charge the close spring 18, close the main contacts 43, and charge the close spring 18 again follows.

In FIG. 8, the mechanism is shown in the discharged open position, that is, the close spring 18 is discharged and the main contacts 43 are open. It can be seen that the cam member 171 is positioned so that the charge cam 173 has its smallest radius in contact with the rocker rollers 165. Thus, the rocker 155 is rotated to a full counterclockwise position and the close spring 18 is at its maximum extension. It can also be seen that the trip mechanism 203 is not latched so that the drive roller 193 is floating although resting against the drive cam 175. As the cam shaft 115 is rotated clockwise manually by the charging handle 31 or through operation of the charge motor (not shown) the charge portion 189*a* of the charge profile on the charge cam 173 which progressively increases in diameter, engages the rocker roller 165 and rotates the rocker 155 clockwise to compress the spring 18. As mentioned, the configuration of this charge portion 189*a* of the profile 189 is selected so that a constant torque is required to compress the spring 18. During this charging of the close spring 18, the driver roller 193 is in contact with a portion of the drive cam profile 191 which has a constant radius so that the drive roller 193 continues to float.

Moving now to FIG. 9, as the close spring 18 becomes fully charged, the drive roller 193 falls off of the drive cam profile 191 into a recess 217. This permits the reset spring 300 to rotate the hatchet plate 205 counterclockwise until the latch ledge 211 passes slightly beyond the trip D shaft 213. This raises the pivot point of the banana link 209 on the hatchet plate 205 so that the drive roller 193 is raised to a position where it rests beneath the recess 217 in the drive cam 175. At the same time, the rocker rollers 165 reach a point just after 170° rotation of the cam member 171 where they enter the charge portion 189*a* of the charge cam profile 189. On this portion 189*a* of the charge cam profile 189, the radius of the charge cam 173 in contact with the rocker rollers 165 decreases in radius with clockwise rotation of the cam member 171. Thus, the close spring 18 applies a force tending to continue rotation of the cam member 171 in the clockwise direction. However, a close prop (not shown in FIG. 9) which is part of a close prop mechanism, described fully in U.S. Pat. No. 6,072,136, engages the stop roller 185 and prevents further rotation of the cam member 171. Thus, the close spring 18 remains fully charged ready to close the main contacts 43 of the circuit breaker 1.

The main contacts 43 of the circuit breaker 1 are closed by release of the close prop. With the close prop disengaged from the stop roller 185, the spring energy is released to rapidly rotate the cam member 171 to the position shown in FIG. 10. As the cam member 171 rotates, the drive roller 193 is engaged by the cam profile 191 of the drive cam 175. The radius of this cam profile 191 increases with cam shaft 115 rotation and since the banana link 209 holds the drive roller 193 in contact with this surface, the pole shaft 33 is rotated to close the main contacts 43 as described in connection with FIG. 2. At this point the latch ledge 211 engages the trip D latch 213 and the main contacts 43 are latched closed. If the circuit breaker 1 is tripped at this point by rotation of the trip D shaft 213 so that this latch ledge 211 is disengaged from the trip D shaft 213, the very large force generated by the compression springs 87 (see FIG. 2) exerted through the main link 195 pulls the pivot point of the banana link 209 on the hatchet plate 205 clockwise downward as the hatchet plate 205 rotates about the hatchet pin assembly 207 (See FIG. 8) and the drive roller 193 drops free of the drive cam 175 allowing the pole shaft 33 to rotate and the main contacts 43 to open. With the main contacts 43 open and the close spring 18 discharged the mechanism would again be in the state shown in FIG. 8.

Figure 11:
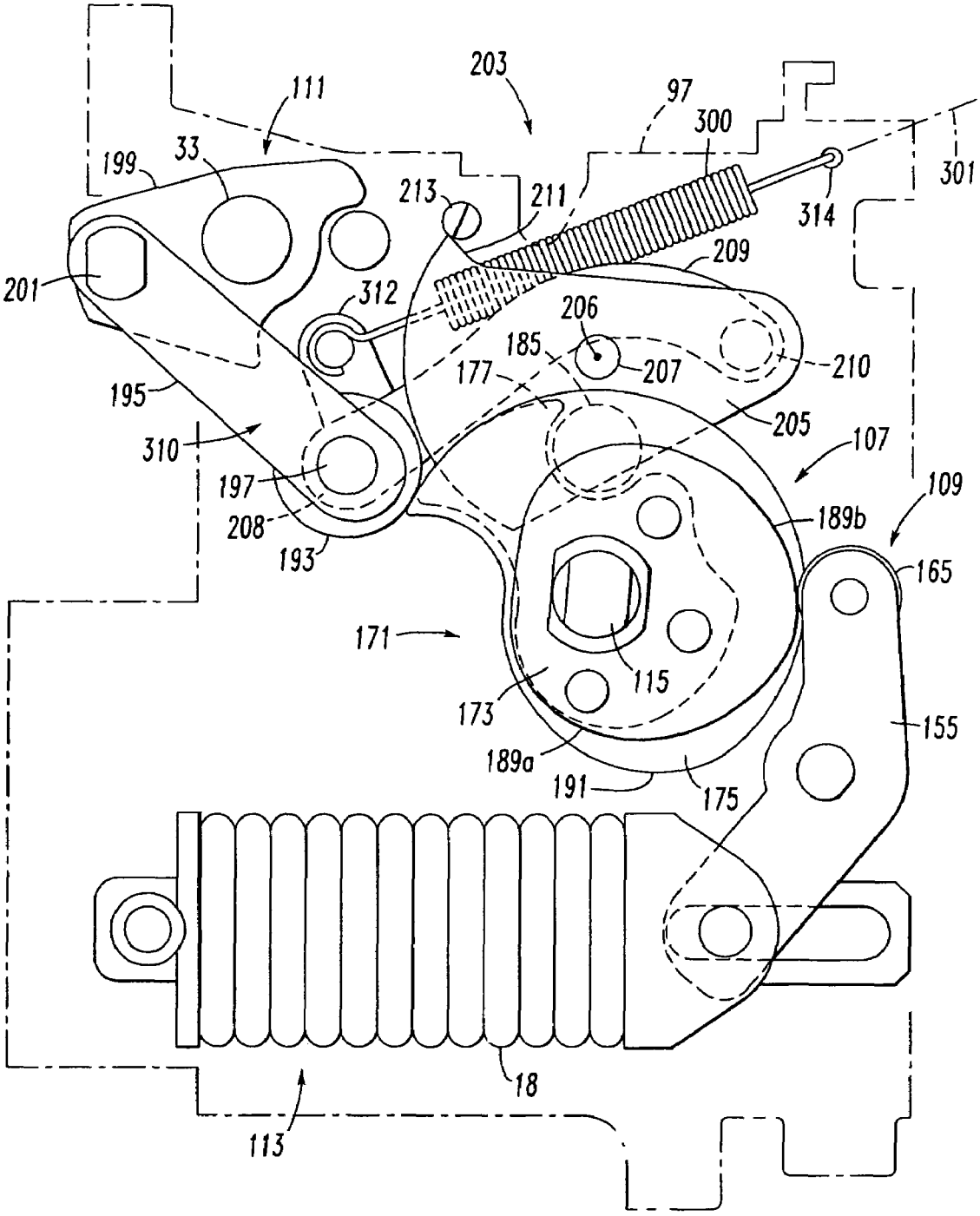
FIG. 11 is a view similar to FIG. 8 shown with the contacts closed and the close spring charged.

Typically, when the circuit breaker 1 is closed, the close spring 18 is recharged, again by rotation of the cam shaft 115 either manually or electrically. This causes the cam member 171 to return to the same position as in FIG. 9, but with the trip mechanism 203 latched, the banana link 209 keeps the drive roller 193 engaged with the drive cam profile 191 on the drive cam 175 as shown in FIG. 11. If the circuit breaker 1 is tripped at this point by rotation of the trip D latch 213 so that the hatchet plate 205 rotates clockwise, the drive roller 193 will drop down into the recess 217 in the drive cam 175 and the circuit breaker 1 will open.

The hatchet plate 205 and the banana link 209 move through three corresponding positions during the sequence of charging and discharging the close spring 18 as shown in FIG. 8-11. As shown in FIG. 8, the hatchet plate 205 and the banana link 209 are in an "open position" wherein the hatchet plate 205 does not engage the D shaft 213 and the hatchet plate 205 is disposed within a notch 215 in the trip D shaft 213 as described above. As set forth in U.S. Pat. No. 6,072,136, the hatchet plate 205 is only in this position after the trip D shaft 213 has been rotated which also causes the main contacts 43 to separate into the open condition. Thus, this position is identified as the "open position" of both the hatchet plate 205 and the banana link 209.

As shown in FIG. 9, and as described above, after the charging of the close spring 18, the hatchet plate 205 has been rotated counter-clockwise about the hatchet pin assembly 207 and the banana link 209, by virtue of the coupling of the banana link second end 210 to the hatchet plate 205, has rotated counter-clockwise about the banana link first end 208. In the configuration shown in FIG. 9, the hatchet plate 205 and the banana link 209 are in a "reset position" wherein the hatchet plate 205 does not engage the trip D shaft 213 but the hatchet plate 205 has moved out of the notch 215 in the trip D shaft 213 and the latch ledge 211 is adjacent to the D shaft 213. Additionally, the trip D shaft 213 has rotated to the latch position as described above.

When the main contacts 43 are closed by discharging the close spring 18, the hatchet plate 205 and the banana link 209 are moved into the "closed position." As shown in FIGS. 10 and 11. In this position, the hatchet plate 205 has rotated slightly clockwise about the hatchet pin assembly 207 so that the latch ledge 211 engages the trip D shaft 213.

The interaction of the hatchet plate 205, the banana link 209 and the reset spring 300 are as follows: The reset spring 300 creates both a compression force in the banana link 209, which creates a reset torque on the hatchet plate 205, and a moment on the banana link 209, which in turn creates a tripping moment on the hatchet plate 205. Since the end of the banana link 209 moves when the circuit breaker 1 closes, this movement can be used to reverse the net torque on the hatchet plate 205 created by the reset spring 300. The direction of forces acting on the components may be controlled by providing a spring offset device 310 as shown in best in FIG. 12. The spring offset device 310 includes an offset member 312 and a spring anchor 314. The spring 300 is coupled to, and extends between, the offset member 312 and spring anchor 314. The location of the offset member 312 and a spring anchor 314 relative to the hatchet pivot pin assembly 207 controls the influence of the spring 300 on the hatchet plate 205 and the banana link 209. The offset member 312 is disposed on, or adjacent to, the banana link first end 208. The spring anchor 314 is disposed on a frame assembly side plate 97 and spaced from said hatchet pin assembly 207. As described above, the hatchet plate 205 is structured to move within a plane. The hatchet pin assembly 207 has an axis of rotation 206 that extends generally perpendicular to the hatchet plate 205 plane of movement. The spring 300 has a longitudinal axis 301. The spring longitudinal axis 301 remains on a single side of the hatchet pin assembly axis 206 as said banana link 209 moves between said closed position and said open position. In this configuration, when said hatchet plate 205 is in the closed position, the spring 300 creates an opening force on hatchet plate 205 that biases the hatchet plate 205 toward the open position, and when the hatchet plate 205 is in the reset position, the spring 300 creates a closing force on the hatchet plate 205 that biases the hatchet plate 205 toward the closed position. Thus, the spring 300 acts to bias the hatchet plate 205 in the desired direction of rotation.

When the spring 300 biases the hatchet plate 205 to the open position, the force on the hatchet plate 205 is an opening force. When the spring 300 biases the hatchet plate 205 to the closed position, the force on the hatchet plate 205 is a closing force. The force acting on the hatchet plate 205 created by the spring 300 ($F_S$) may be calculated as follows. It is noted that, typically, there are other forces acting on the hatchet plate 205 as well. The downward reaction force ($F_R$) on the pin which connects the banana link 209 to the hatchet plate 205, by taking the balance of moments on the banana link 209 about the lower pin, may be expressed as follows:

$$F_R = F_S\,(L_{lever}/L_B)$$

Taking a sum of moments on the hatchet plate 205 about its pivot shaft we can derive an expression for the incremental force on the hatchet latch, $F_{latch}$:

$$F_{latch}R_6 + F_S R_5 - F_R R_9 = 0$$

Substituting for $F_R$ from the first equation we have:

$$F_{latch}R_6 + F_S\,(R_5 - (L_{lever}R_9/L_B)) = 0$$

Solving for the latch force we get:

$$F_{latch} = (F_S/R_6)((L_{lever}R_9/L_B) - R_5)$$

Wherein $F_S$=the return spring force $R_6$=the moment arm of the latch about the hatchet pivot =1.63"

$L_{lever}$=the length of the reset spring lever arm $R_9$=the length from the hatchet pin assembly axis 206 to banana link first end 208 =1.25"

$L_B$=the length of the banana link =3.50"

$R_5$=the moment arm of the banana link 209 line-of force about the hatchet pin assembly axis 206; which, in the preferred embodiment =0.117" when in the closed position and 0.55" when in the open position.

The opening reset latch force created by the reset spring 300 is, preferably, between about one and three lbs. The closing tripping latch force due to the reset spring 300 is, preferably, between about one and three lbs. However, in the preferred embodiment, the lever length is about 1.00 inch and the spring 300 force is about 10.0 lbs. Thus, in the preferred embodiment there is an opening force ($F_{latch,\ open}$=) of −1.2 lbs and a closing force ($F_{latch,\ closed}$=) of 1.5 lbs. This calculation illustrates that the load on the hatchet plate 205 reverses as the breaker closes. In the preferred embodiment, the latch "load" on the hatchet plate 205 is negative 1.2 pounds (resets) in the open position and in the closed position it reverses and becomes a positive 1.5 lbs. The corresponding vertical loads at the banana link 209 upper pin are 1.9 lbs upward and 1.6 lbs downward.

Figure 12:
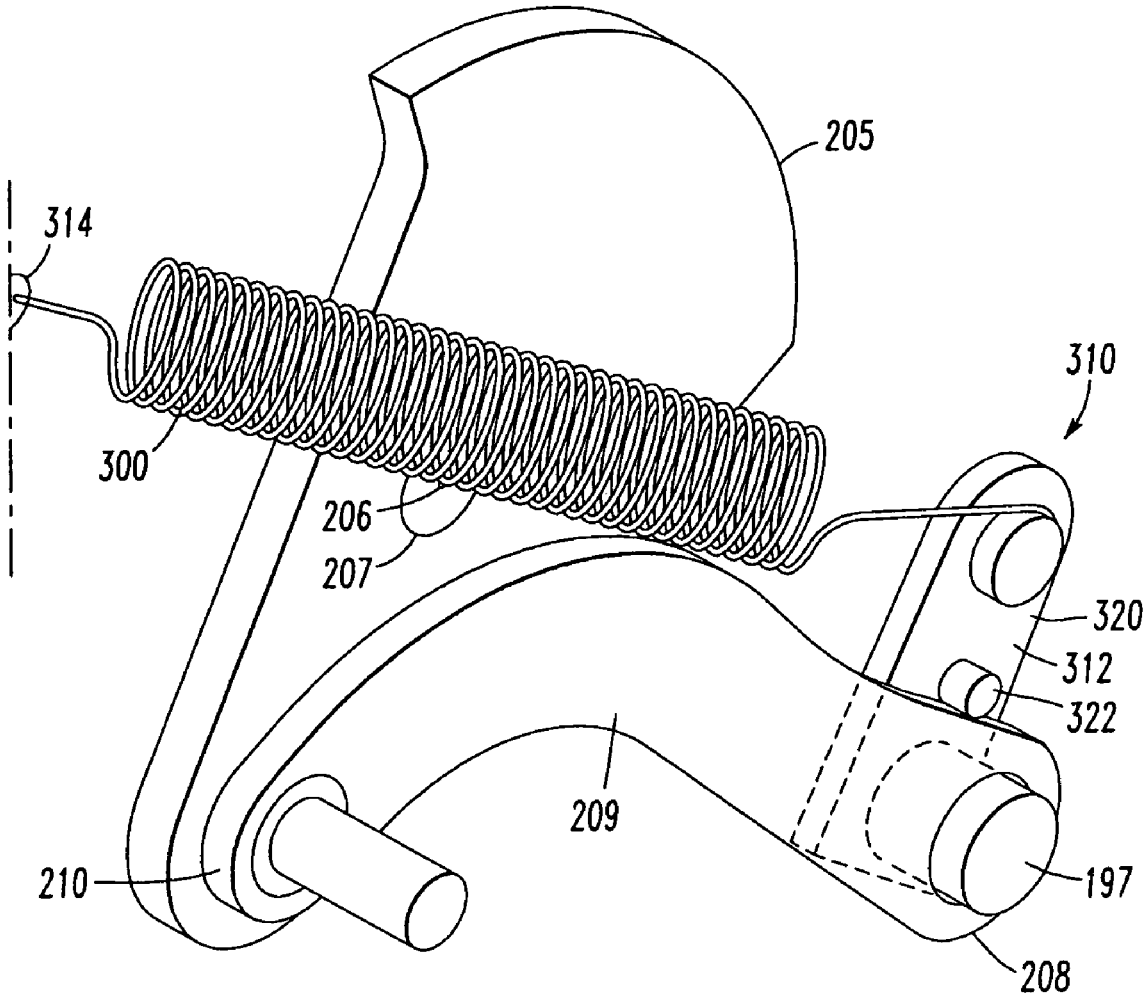
FIG. 12 is an isometric view of one embodiment of the offset device coupled to the banana link.

As shown in FIG. 12, the offset member 312 may be a separate, elongated, planar member 320 that is coupled to the banana link 209. In this embodiment, the member 320 has a perpendicular tab 322. Thus, when the member 320 is disposed adjacent to the banana link 209, the perpendicular tab 322 extends over and engages the banana link 209. In the preferred embodiment, as shown in FIG. 8, the offset member 312 is simply incorporated into the banana link 209.

While specific embodiments of the invention have been described in detail, it will be appreciated by those skilled in the art that various modifications and alternatives to those details could be developed in light of the overall teachings of the disclosure. For example, the circuit breaker 1 described above is structured so that the banana link 209 has the eponymous "banana" shape. However, a circuit breaker with a different layout may have a straight link, or an link of another shape, as required. Accordingly, the particular arrangements disclosed are meant to be illustrative only and not limiting as to the scope of invention which is to be given the full breadth of the claims appended and any all equivalents thereof.

What is claimed is:

1. A spring offset device structured to extend between a circuit breaker frame assembly and a trip mechanism, said trip mechanism having a banana link and hatchet plate, said frame assembly supporting a hatchet pin assembly, said banana link being an elongated member having a first end and a second end, said second end coupled to said hatchet plate, said hatchet plate being pivotally mounted on said hatchet pin assembly and structured to move between a closed position, an open position, and a reset position, said banana link also structured to move with said hatchet plate into a corresponding closed position, a open position, and a reset position, said spring offset device comprising:

an offset member disposed on said banana link;

a spring anchor disposed on said frame assembly, said spring anchor spaced from said hatchet pin assembly;

a spring extending between said offset member and said spring anchor;

wherein said offset member and said spring anchor are structured so that when said hatchet plate is in said closed position, said spring creates an opening force on said hatchet plate biasing said hatchet plate toward the open position, and when said hatchet plate is in the reset position, said spring creates a closing force on said hatchet plate biasing said hatchet plate toward said reset position.

2. The spring offset device of claim 1 wherein:

said hatchet plate is structured to move within a plane;

said hatchet pin assembly has an axis of rotation that extends generally perpendicular to said hatchet plate plane of movement;

said spring has a longitudinal axis; and wherein when said spring longitudinal axis remains on a single side of said hatchet pin assembly axis as said banana link moves between said closed position, said open position, and said reset position.

3. The spring offset device of claim 1 wherein said offset member is disposed on said banana link adjacent said first end.

4. The spring offset device of claim 3 wherein said offset member is incorporated into said banana link.

5. The spring offset device of claim 3 wherein said offset member is coupled with said banana link.

6. The spring offset device of claim 5 wherein:

said banana link is a planar member; and said offset member is an elongated, planar member having a perpendicular tab, said offset member being disposed adjacent to said banana link so that said perpendicular tab engages said banana link.

7. A circuit breaker comprising:

a housing with an internal frame assembly;

at least one pair of main contacts disposed in said housing, said contacts structured to move between a first, open position and a second, closed position;

an operating mechanism coupled to said at least one pair of main contacts and structured to separate said at least one pair of main contacts, said operating mechanism including a trip mechanism;

said tripping mechanism having a trip mechanism banana link, a hatchet plate, a hatchet pin assembly; and a spring offset device;

said hatchet pin assembly coupled to said frame assembly;

said operating mechanism structured to create a tripping torque on said hatchet plate;

said banana link being an elongated member having a first end and a second end, said second end coupled to said hatchet plate;

said hatchet plate being pivotally mounted on said hatchet pin assembly and structured to move between a closed position, an open position, and a reset position;

said banana link structured to move with said hatchet plate into a corresponding closed position, an open position, and a third reset position;

said spring offset device having an offset member disposed on said banana link, a spring anchor disposed on said frame assembly, said spring anchor spaced from said hatchet pin assembly, and a spring extending between said offset member and said spring anchor; and wherein said offset member and said spring anchor are structured so that when said hatchet plate is in said closed position, said spring creates an opening force on said hatchet plate biasing said hatchet plate toward the open position, and when said hatchet plate is in the reset position, said spring creates a closing force on said hatchet plate biasing said hatchet plate toward said closed position.

8. The circuit breaker of claim 7 wherein:

said hatchet plate is structured to move within a plane;

said hatchet pin assembly has an axis of rotation that extends generally perpendicular to said hatchet plate plane of movement;

said spring has a longitudinal axis; and wherein when said spring longitudinal axis remains on a single side of said hatchet pin assembly axis as said banana link moves between said closed position, said open position, and said reset position.

9. The circuit breaker of claim 7 wherein said operating mechanism is structured to create a tripping torque that is greater than the torque created by said spring force when said hatchet plate is in said closed position and wherein said spring offset device is structured to create a reset torque greater than said tripping torque when said hatchet plate is in reset position.

10. The circuit breaker of claim 7 wherein said opening force is between about 1 and 3 lbs.

11. The circuit breaker of claim 10 wherein said closing force is between about 1 and 3 lbs.

12. The circuit breaker of claim 11 wherein said closing force is about 1.5 lbs.

13. The circuit breaker of claim 7 wherein said opening force is about 1.2 lbs.

14. The circuit breaker of claim 7 wherein said closing force is between about 1 and 3 lbs.

15. The circuit breaker of claim 7 wherein said closing force is about 1.5 lbs.

16. The circuit breaker of claim 7 wherein said offset member is disposed on said banana link adjacent said first end.

17. The circuit breaker of claim 16 wherein said offset member is incorporated into said banana link.

18. The circuit breaker of claim 16 wherein said offset member is coupled with said banana link.

19. The circuit breaker of claim 18 wherein:

said banana link is a planar member; and said offset member is an elongated, planar member having a perpendicular tab, said offset member being disposed adjacent to said banana link so that said perpendicular tab engages said banana link.

* * * * *